US007955475B2

(12) United States Patent
Yazaki et al.

(10) Patent No.: US 7,955,475 B2
(45) Date of Patent: Jun. 7, 2011

(54) PAPERMAKING SHOE PRESS BELT

(75) Inventors: Takao Yazaki, Tokyo (JP); Shintaro Yamazaki, Tokyo (JP); Yuya Takamori, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 0 days.

(21) Appl. No.: 12/718,218

(22) Filed: Mar. 5, 2010

(65) Prior Publication Data

US 2011/0017419 A1 Jan. 27, 2011

Related U.S. Application Data

(60) Provisional application No. 61/227,390, filed on Jul. 21, 2009.

(30) Foreign Application Priority Data

Jul. 21, 2009 (JP) ..... 2009-170129

(51) Int. Cl.
*D21F 3/02* (2006.01)

(52) U.S. Cl. ..... 162/358.4; 162/901

(58) Field of Classification Search ..... 162/306, 162/358.3, 358.4, 901; 442/64–67, 71; 528/59–66
See application file for complete search history.

(56) References Cited

U.S. PATENT DOCUMENTS

| | | | | |
|---|---|---|---|---|
| 2004/0029474 | A1* | 2/2004 | Watanabe et al. | 442/181 |
| 2005/0197478 | A1* | 9/2005 | Watanabe | 528/49 |
| 2007/0213157 | A1* | 9/2007 | Noda | 474/237 |
| 2010/0147480 | A1* | 6/2010 | Yazaki et al. | 162/358.4 |
| 2010/0314067 | A1 | 12/2010 | Yazaki et al. | |

FOREIGN PATENT DOCUMENTS

| | | | |
|---|---|---|---|
| EP | 1 338 696 | A1 | 8/2003 |
| EP | 1 338 696 | B1 | 8/2003 |
| EP | 1 580 316 | A1 | 9/2005 |
| EP | 1 688 446 | A2 | 8/2006 |
| JP | 5-43645 | * | 2/1993 |
| JP | 11-511801 | | 10/1999 |
| JP | 3698984 | | 7/2005 |
| JP | 2005-307421 | | 11/2005 |
| JP | 3803106 | | 5/2006 |
| JP | 2006-144139 | | 6/2006 |
| JP | 2008-111220 | | 5/2008 |
| JP | 2008-285784 | | 11/2008 |
| WO | WO 2006/054498 | A1 | 5/2006 |
| WO | WO 2008/143108 | A1 | 11/2008 |

OTHER PUBLICATIONS

U.S. Appl. No. 12/666,301, filed Dec. 23, 2009, Yazaki, et al.
U.S. Appl. No. 12/600,487, Dec. 30, 2009, Yazaki, et al.

* cited by examiner

*Primary Examiner* — Eric Hug
(74) *Attorney, Agent, or Firm* — Oblon, Spivak, McClelland, Maier & Neustadt, L.L.P.

(57) ABSTRACT

A papermaking shoe press belt is formed of a reinforcing fiber base material and a polyurethane layer integrated with each other. The reinforcing fiber base material is embedded in the polyurethane layer. The papermaking shoe press belt includes, as the polyurethane layer, a polyurethane layer obtainable by curing a composition composed in combination of a urethane prepolymer and one or more curing agent. The urethane prepolymer is obtainable by reacting a p-phenylene diisocyanate compound with a long-chain polyol. The at least one curing agent is selected from 4,4'-methylene bis(2,6-diethyl-3-chloroaniline), 4,4'-methylene bis(2-chloroaniline), methylene bis(2-ethyl-6-methylaniline), 4,4'-methylene bis(2-ethylbenzeneamine), methylene bis(2,3-dichloroaniline), 4,4'-methylenedianiline, 3,5-dimethylthiotoluene-2,4-diamine, 3,5-dimethylthiotoluene-2,6-diamine, 3,5-diethyltoluene-2, 4-diamine, 3,5-diethyltoluene-2,6-diamine, polytetramethylene oxide di-p-aminobenzoate, poly(tetramethylene/3-methyl tetramethylene ether)glycol bis(4-aminobenzoate) , trimethylene bis(4-aminobenzoate) and isobutyl 4-chloro-3,5-diaminobenzoate.

2 Claims, 5 Drawing Sheets

PAPERMAKING SHOE PRESS BELT

FIELD OF THE INVENTION

This invention relates to a papermaking shoe press belt (which may hereinafter be called a "shoe press belt") used in a papermaking shoe press apparatus, and especially to a shoe press belt used in a closed shoe press belt. More specifically, the present invention is concerned with a shoe press belt, which has a resin layer made of a polyurethane of a particular composition and is excellent in properties such as shape retaining properties, especially concave groove-shape retaining properties.

BACKGROUND ART

As shown in FIG. 3, a papermaking shoe press apparatus makes use of a shoe press mechanism that a loop-shaped shoe press belt 2 is interposed between a press roll 1 and a shoe 5. Through a press section constructed of the press roll 1 and the shoe 5, a transfer felt 3 and a wet paper web 4 are caused to pass to perform dehydration.

As shown in FIG. 2, the shoe press belt 2 is constructed of a reinforcing fiber base material 6 and an outer circumferential polyurethane layer 21 and an inner circumferential polyurethane layer 22 arranged on opposite sides of the reinforcing fiber base material 6, respectively, such that the reinforcing fiber base material 6 is enclosed (embedded) in the resulting polyurethane layer. Further, a number of concave grooves 24 are formed in a surface of the outer circumferential polyurethane layer 21, the surface being to be disposed on the side of the press roll, such that water squeezed out from the wet paper web 4 upon pressing can be held in the concave grooves 24 and the thus-held water can then be transferred out of the press section as a result of rotation of the belt itself. Therefore, the concave grooves 24 arranged in the outer circumferential polyurethane layer 21 on the side of the press roll are required to be improved in shape retaining properties when pressed between the press roll 1 and shoe 5. In addition, convex areas 25 are also required to be improved in mechanical properties such as cracking resistance, flexing fatigue resistance and abrasion resistance to pressing force applied in a vertical direction by the press roll 1 and friction by the shoe press belt and flexing fatigue in a shoe press region.

For such reasons, polyurethane excellent in cracking resistance and abrasion resistance is widely used as a resin material that forms the outer circumferential polyurethane layer 21 of the shoe press belt 2.

For example, proposed is a shoe press belt formed of a reinforcing fiber base material and a polyurethane integrated with each other, in which the polyurethane is formed of an outer circumferential layer and an inner circumferential layer and the reinforcing fiber base material is embedded in the polyurethane. The polyurethane that forms the outer circumferential layer is a polyurethane, which has a JIS A hardness of 89 to 94 degrees and is obtainable by curing a composition of a urethane prepolymer ("HIPRENE L," trade name; product of Mitsui Chemicals, Inc.), which is obtainable by reacting tolylene diisocyanate (TDI) with polytetramethylene glycol (PTMG) and has terminal isocyanate groups, and a dimethylthiotoluenediamine-containing curing agent, in which the urethane prepolymer and the curing agent are mixed together in a ratio such that the value of an equivalent ratio (H/NCO) of active hydrogen groups (H) in the curing agent to the isocyanate groups (NCO) in the urethane prepolymer satisfies $1<H/NCO<1.15$. The polyurethane that forms the inner circumferential layer is a polyurethane, which is obtainable by curing a composition of a urethane prepolymer (product of Mitsui Chemicals, Inc.), which is obtainable by reacting 4,4'-methylene bis(phenylisocyanate) (MDI) with polytetramethylene glycol (PTMG) and has terminal isocyanate groups, and a mixed curing agent, which contains 65 parts of dimethylthiotoluenediamine and 35 parts of polytetramethylene glycol (PTMG), in which the urethane prepolymer and the curing agent are mixed together in a ratio such that the value of an equivalent ratio (H/NCO) of active hydrogen groups (H) in the curing agent to the isocyanate groups (NCO) in the urethane prepolymer satisfies $0.85 \leqq H/NCO<1$ (see Patent Document 1 and Patent Document 2).

Also proposed is a shoe press belt formed of a reinforcing fiber base material and a polyurethane integrated with each other, in which the polyurethane is formed of an outer circumferential layer and an inner circumferential layer and the reinforcing fiber base material is embedded in the polyurethane. The polyurethane that forms the outer circumferential layer and the inner circumferential layer is a polyurethane of a JIS A hardness of 94 to 95 degrees, obtainable by curing a composition of a urethane prepolymer ("HIPRENE L"), which is obtainable by reacting tolylene diisocyanate (TDI) with polytetramethylene glycol (PTMG) and has terminal isocyanate groups, and a dimethylthiotoluenediamine-containing curing agent, in which the urethane prepolymer and the curing agent are mixed together in a ratio such that the value of an equivalent ratio (H/NCO) of active hydrogen groups (H) in the curing agent to the isocyanate groups (NCO) in the urethane prepolymer becomes 0.97 (see Patent Document 3).

Further proposed are a shoe press belt formed of a reinforcing fiber base material and a polyurethane integrated with each other, in which the reinforcing fiber base material is embedded in the polyurethane. The polyurethane of a JIS A hardness of 93 to 96 degrees, which contains a non-reactive and liquid polydimethylsiloxane, is obtainable by curing a composition of a urethane prepolymer, which is obtainable by reacting tolylene diisocyanate (TDI) with polytetramethylene glycol (PTMG), has terminal isocyanate groups and a curing agent, which is selected from dimethylthiotoluenediamine ("ETHACURE 300," trade name; product of Albemarle Corporation) and 4,4-methylene bis(2-chloroaniline)("MOCA," trademark; product of E.I. DuPont de Nemours & Company), in which the urethane prepolymer and the curing agent are mixed together in a ratio to satisfy $0.9 \leqq H/NCO \leqq 1.10$. Further proposed a shoe press belt as described above, in which the polyurethane has a JIS A hardness of 90 to 93 degrees and is obtainable by curing a composition of a blended mixture of a first urethane prepolymer, which contains a non-reactive, liquid polydimethylsiloxane and can have a JIS A hardness of 90 to 93 degrees, and a second urethane prepolymer, which not contains non-reactive, liquid polydimethylsiloxane and can have a JIS A hardness of 98 degrees after curing, and dimethylthiotoluenediamine as a curing agent, in which the urethane prepolymer blend and the curing agent are mixed together in a ratio to satisfy $0.9 \leqq H/NCO \leqq 1.10$ (see Patent Document 4).

Still further proposed are a shoe press belt formed of a reinforcing fiber base material and a polyurethane integrated with each other, in which the reinforcing fiber base material is embedded in the polyurethane, the polyurethane has a JIS A hardness of 92 to 100 degrees and is obtainable by curing a composition of a urethane prepolymer, which is obtainable by reacting p-phenylene diisocyanate (PPDI) with polytetramethylene glycol (PTMG) and has terminal isocyanate groups, and a curing agent, which contains 85 to 99.9 mol % of 1,4-butanediol and 15 to 0.1 mol % of an aromatic polyamine containing active hydrogen groups (H), in which the urethane prepolymer and the curing agent are mixed together in a ratio to satisfy 0.88≦H/NCO≦1.12; and a shoe press belt as described above, in which the polyurethane has a JIS A hardness of 92 to 99 degrees and is obtainable by curing a composition of a urethane prepolymer, which is obtainable by reacting p-phenylene diisocyanate (PPDI) with polytetramethylene glycol (PTMG) and has terminal isocyanate groups, and a curing agent, which is selected from 1,4-butanediol, hydroquinone bis(β-hydroxyethyl)ether, 3,5-diethyltoluenediamine and 3,5-dimethylthiotoluenediamine, in which the urethane prepolymer and the curing agent are mixed together in a ratio to satisfy 0.88≦H/NCO≦1.00 (see Patent Document 5 and Patent Document 6).

The shoe press belts described in the Examples of Patent Documents 1 to 4 referred to in the above were each so excellent that it developed no crack even after one million reciprocations when its specimen was measured for the number of reciprocations until a crack would have been formed at a reciprocation speed of 40 cm/sec while applying a tension of 3 kg/cm and a pressure of 36 kg/cm$^2$ by an instrument for testing cracking resistance of the type that the specimen was held at opposite ends thereof by clamp hands, the clamp hands were arranged reciprocably in a horizontal direction in an interlocked relation, the specimen was disposed with a surface thereof, which was to be evaluated, directed toward a rotating roll, and a press shoe was moved toward the rotating roll to press the specimen.

The use environment of shoe press belts has, however, become increasingly severer in recent years as a result of increases in operation speed, width enlargements of shoe press belts to about 10 m and higher pressures at press sections, all of which have stemmed from improvements in the productivity of paper. There is hence an outstanding demand for improvements in mechanical properties such as shape retaining properties, especially concave groove-shape retaining properties, cracking resistance, flexing fatigue resistance and abrasion resistance.

Further, the shoe press belts described in the Examples of Patent Documents 5 and 6 referred to in the above were each subjected to a crack forming test under the below-described conditions by using an instrument shown in FIG. 4. As the size of a specimen 41, its width was 60 cm, and the length between grips was 70 mm. By causing a lower grip 42*a* to undergo a reciprocal motion in a circular arc, an upper grip 42*b* and the specimen were also reciprocated so that the specimen was flexed and fatigued at a tip of the lower grip. The distance from a center of the circular arc to the tip of the lower grip was set at 168 mm, the distance of a movement of the lower grip was set at 161 mm, and the reciprocation speed was set at 162 reciprocations/min. The weight of the upper grip was set at 400 g. The specimen was repeatedly flexed to determine the number of flexions until a crack was formed. Those shoe press belts developed no crack even after 0.7 million flexions, and therefore, were excellent with improved abrasion resistance.

However, the shoe press belts described in Patent Documents 1 to 6 referred to in the above were not improved in shape retaining properties, especially concave groove-shape retaining properties that affect water squeezability.

Prior Art Documents

Patent Documents

[Patent document 1] JP B 3698984
[Patent document 2] JP B 3803106
[Patent document 3] JP A 2005-307421
[Patent document 4] JP A 2006-144139
[Patent document 5] JP A 2008-111220
[Patent document 6] JP A 2008-285784

SUMMARY OF THE INVENTION

Problem to be Solved by the Invention

An object of the present invention is to provide a shoe press belt equipped with still better shape retaining properties, especially concave groove-shape retaining properties.

Means for Solving Problem

In the course of research enthusiastically conducted to achieve the above-described object, the present inventors found that the above-described problem can be resolved by selecting a specific curing agent as a curing agent for forming a polyurethane layer. The present inventors then proceeded further with the research, leading to the completion of the present invention.

Thus, the present invention, relates to a papermaking shoe press belt formed of a reinforcing fiber base material and a polyurethane layer integrated with each other, the reinforcing fiber base material being embedded in the polyurethane layer, wherein the papermaking shoe press belt includes, as the polyurethane layer, a polyurethane layer obtainable by curing a composition composed in combination of a urethane prepolymer (A) obtainable by reacting an isocyanate compound, which includes a p-phenylene diisocyanate compound, with a long-chain polyol and having terminal isocyanate groups, and a curing agent (B) having active hydrogen groups (H) containing one or more organic polyamine compound having active hydrogen groups (H) selected from 4,4'-methylene bis(2,6-diethyl-3-chloroaniline), 4,4'-methylene bis(2-chloroaniline), methylene bis(2-ethyl-6-methylaniline), 4,4'-methylene bis(2-ethylbenzeneamine), methylene bis(2,3-dichloroaniline), 4,4'-methylenedianiline, 3,5-dimethylthiotoluene-2,4-diamine, 3,5-dimethylthiotoluene-2,6-diamine, 3,5-diethyltoluene-2,4-diamine, 3,5-diethyltoluene-2,6-diamine, polytetramethylene oxide di-p-aminobenzoate, poly(tetramethylene/3-methyl tetramethylene ether)glycol bis(4-aminobenzoate), trimethylene bis(4-aminobenzoate) and isobutyl 4-chloro-3,5-diaminobenzoate.

The present invention also relates to the papermaking shoe press belt in which the isocyanate compound may include 55 to 100% of the p-phenylene diisocyanate compound.

The present invention also relates to the papermaking shoe press belt, wherein a papermaking shoe press belt comprising a polyurethane layer obtainable by curing a composition of a urethane prepolymer, which is obtainable by reacting p-phenylene diisocyanate with polytetramethyleneglycol, and a curing agent consisting of dimethylthiotoluenediamine is excluded.

The present invention further relates to the papermaking shoe press belt in which the component (B) may be a metal complex with a metal salt.

The present invention also relates to the papermaking shoe press belt in which the complex may preferably be dispersed in a dispersion medium.

As the dispersion medium, a high boiling-point ester solvent or the like can be used. Usable examples include dioctyl phthalate (DOP) as a phthalate ester and dioctyl adipate (DOA) as an adipate ester. They can be used either singly or in combination.

The present invention also relates to the papermaking shoe press belt in which the wherein said curing agent (B) comprises one or more curing agent(s) selected from the following constituent ($B_1$), ($B_2$), and ($B_3$):

a curing agent ($B_1$), which comprises 65 to 100 mol % of a complex of 4,4'-methylenedianiline and sodium chloride, a curing agent ($B_2$), which comprises 65 to 100 mol % of one or two selected from 4,4'-methylene bis(2,6-diethyl-3-chloroaniline) and 4,4'-methylene bis(2-chloroaniline), a curing agent ($B_3$), which consists of 3,5-dimethylthiotoluenediamine and 3,5-diethyltoluenediamine.

The present invention further relates to the shoe press belt in which the metal salt may preferably be sodium chloride.

The present invention further relates to the process for making a papermaking shoe press belt formed of a reinforcing fiber base material and a polyurethane layer integrated with each other, said reinforcing fiber base material being embedded in the polyurethane layer, have a tensile strain of 25.1% or less and/or a retention rate (%) of cross-sectional concave-groove area of 90% or more, comprising applying a curing agent comprising 65 to 100 mol % of one or more organic polyamine compounds having active hydrogen groups (H) as a curing agent, when a polyurethane layer is formed by curing a composition of a urethane prepolymer (A) obtainable by reacting an isocyanate compound, which comprises a p-phenylene diisocyanate compound with a long-chain polyol and having terminal isocyanate groups, and a curing agent (B) having active hydrogen groups (H).

Effect of the Invention

The use of the a compound having a terminal isocyanate group obtainable by reacting an isocyanate compound, including a p-phenylene diisocyanate compound, with a long-chain polyol as a urethane prepolymer (A) and a compound which includes one ore more organic polyamine compound having an active hydrogen groups (H), selected from 4,4'-methylene bis(2,6-diethyl-3-chloroaniline), 4,4'-methylene bis(2-chloroaniline), methylene bis(2-ethyl-6-methylaniline), 4,4'-methylene bis(2-ethylbenzeneamine), methylene bis(2,3-dichloroaniline), 4,4'-methylenedianiline, 3,5-dimethylthiotoluene-2,4-diamine, 3,5-dimethylthiotoluene-2,6-diamine, 3,5-diethyltoluene-2,4-diamine, 3,5-diethyltoluene-2,6-diamine, polytetramethylene oxide di-p-aminobenzoate, poly(tetramethylene/3-methyl tetramethylene ether)glycol bis(4-aminobenzoate), trimethylene bis(4-aminobenzoate) and isobutyl 4-chloro-3,5-diaminobenzoate as the curing agent (B) in an outer circumferential polyurethane layer of the shoe press belt, which is to be disposed opposite the side of a wet paper web, makes it possible to form an excellent polyurethane and thus to provide the shoe press belt with excellent shape retaining properties, especially concave groove-shape retaining properties. Described specifically, the shoe press belt according to the present invention is excellent especially in concave groove-shape retaining properties compared with conventional products.

EMBODIMENT FOR PERFORMING THE INVENTION

Figure 1A:
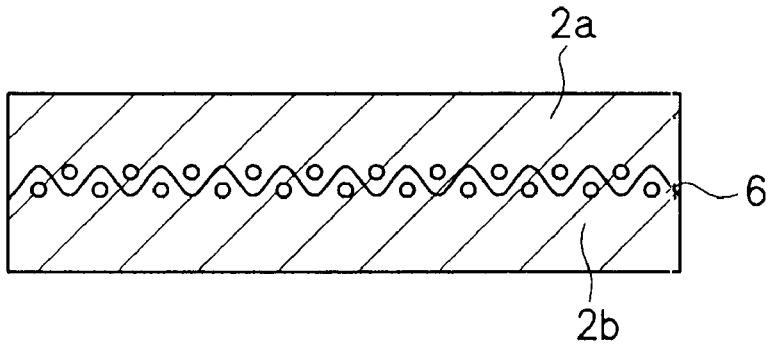
FIGS. 1A to 1C are cross-sectional views of shoe press belts according to different embodiments of the present invention.

Referring to the accompanying drawings, the present invention will hereinafter be described more specifically based on preferred embodiments. It should, however, be noted that the present invention shall not be limited to such embodiments as shown in the drawings.

Figure 1B:
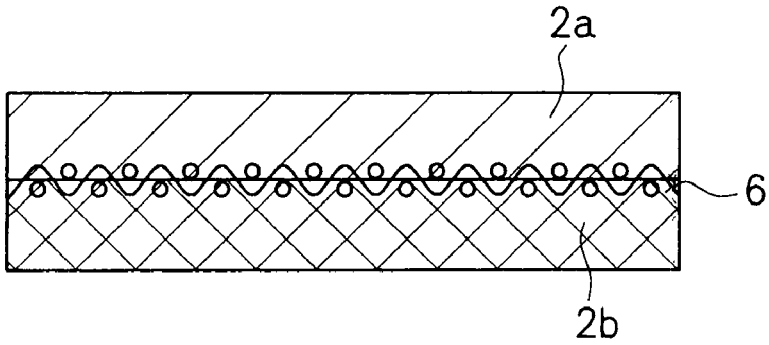
Figure 1C:
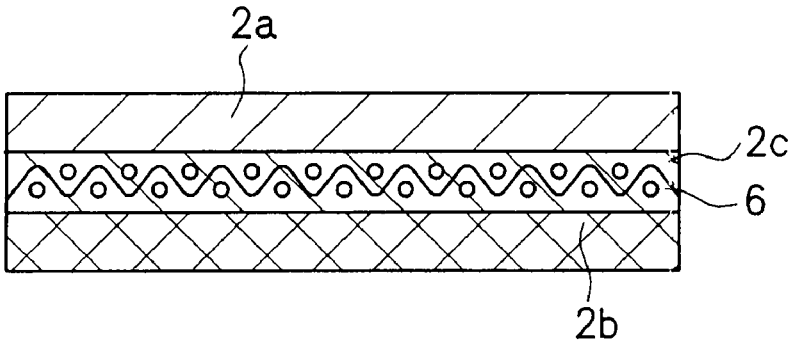
Figure 2:
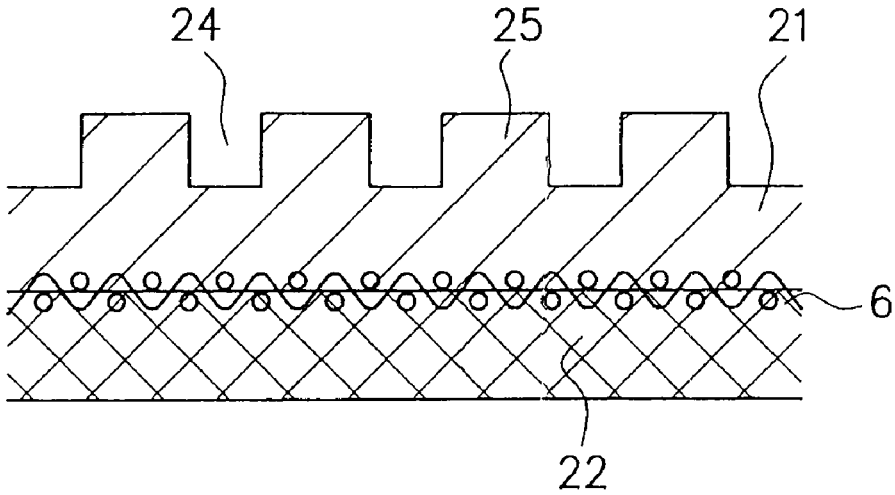
FIG. 2 is a cross-sectional view of a shoe press belt.
Figure 3:
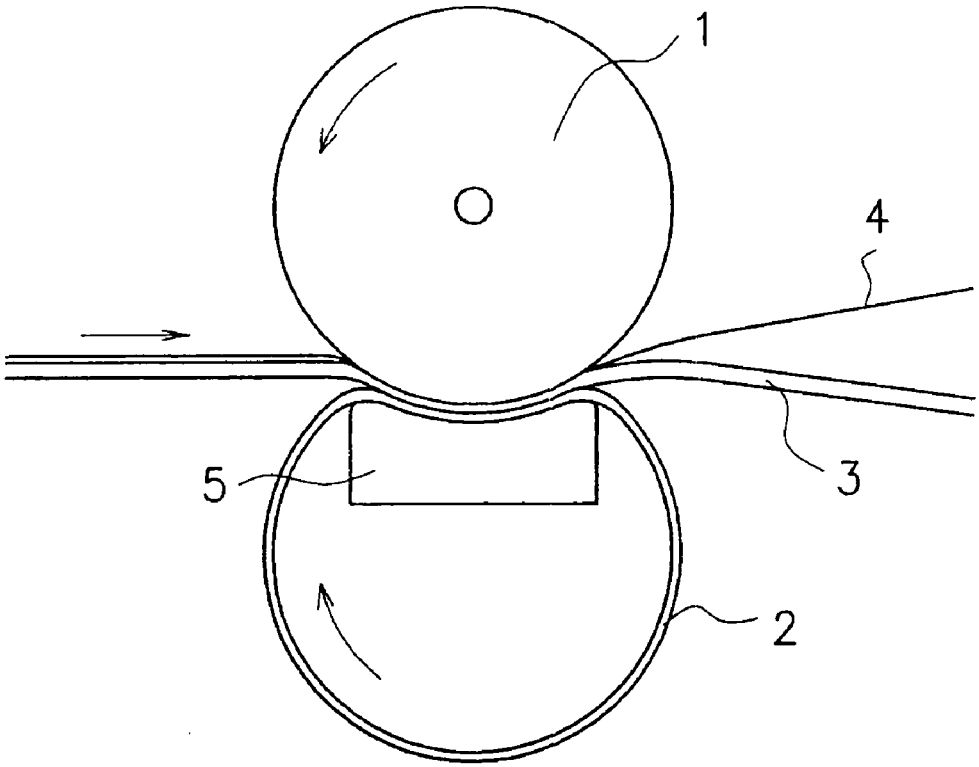
FIG. 3 is a schematic view of a shoe press apparatus.
Figure 4:
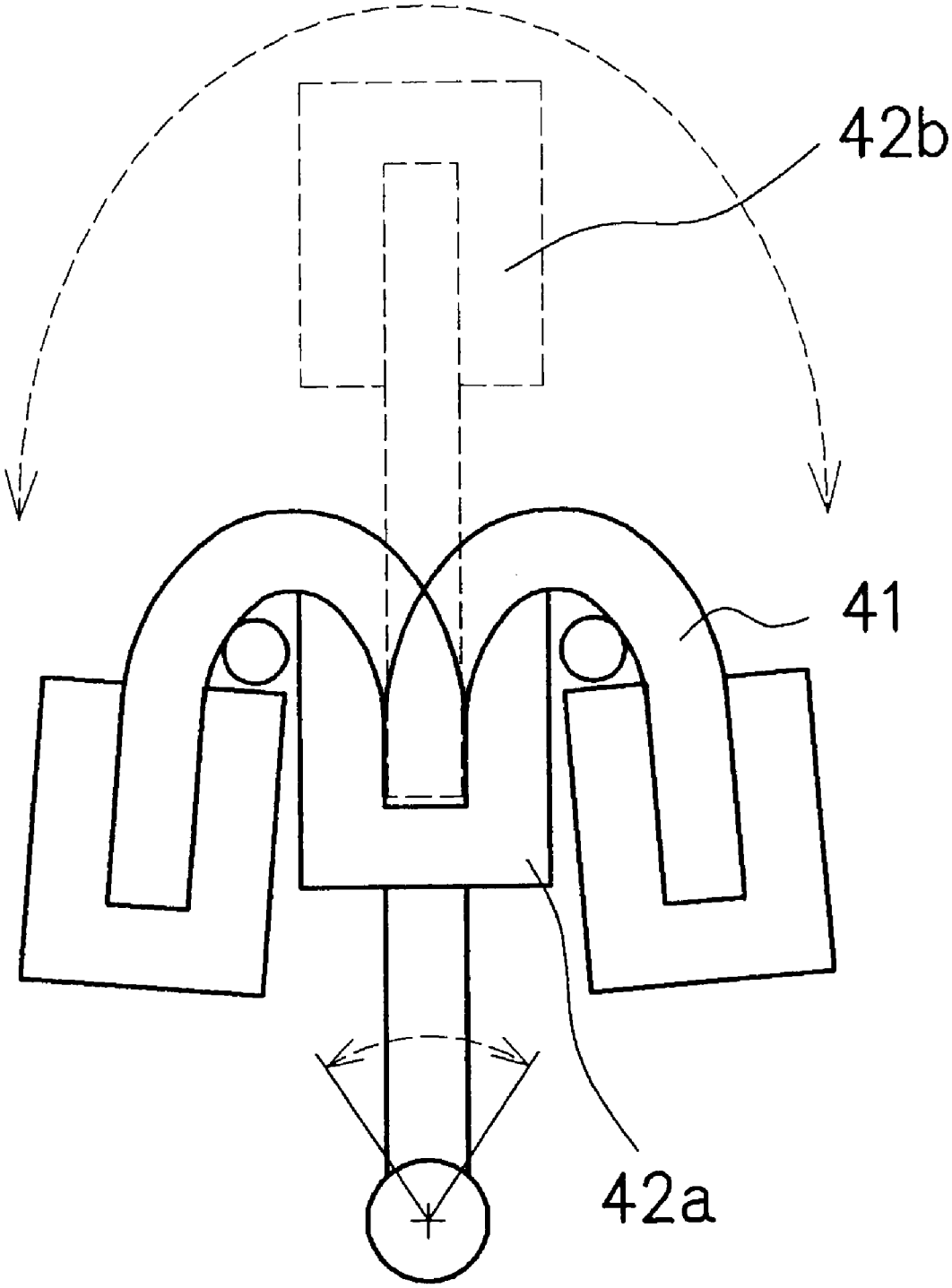
FIG. 4 is a schematic view illustrating a flexing fatigue test.
Figure 5:
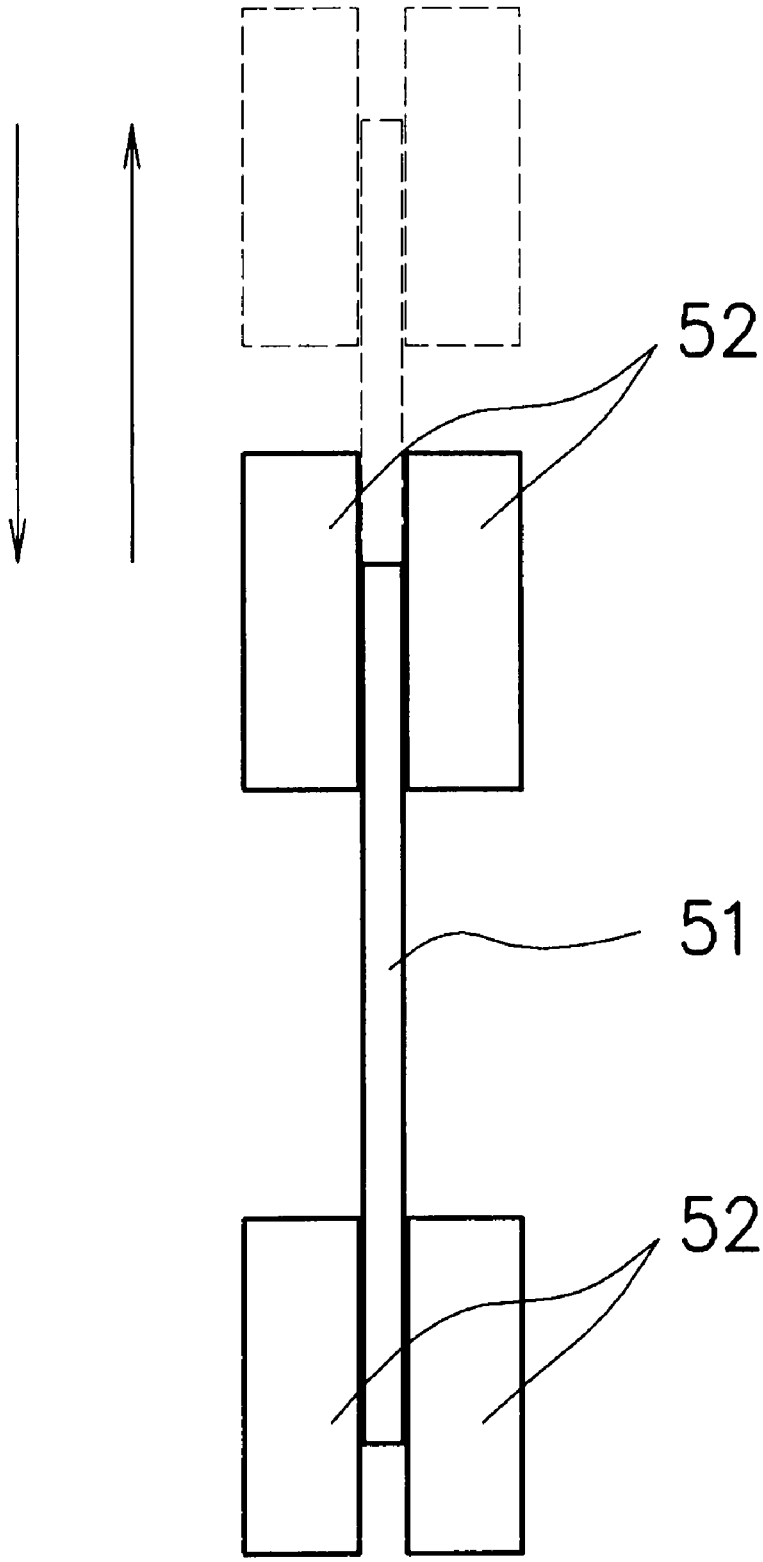
FIG. 5 is a schematic view illustrating a tensile strain test.

FIG. 1A to 1C are cross-sectional views of a shoe press belt according to the present invention, in which a reinforcing fiber base material and a polyurethane are integrated with each other and the reinforcing fiber base material is embedded in the polyurethane. The polyurethane is in the form of a single layer in FIG. 1A, is in the form of two layers in FIG. 1B, and is in the form of three layers in FIG. 1C. In each of these shoe press belts, an outer circumferential polyurethane layer of the shoe press belt, the layer being to be disposed opposite to the side of a wet paper web, is formed of a polyurethane according to the present invention. FIG. 2 is a schematic cross-sectional view of a shoe press belt according to the present invention in which a concave groove 24 is formed. Depending on the shape and depth of the grooves, the concave groove/convex-area width ratio and so on, shoe press belts of various types are available. FIG. 3 is a simplified schematic view of a shoe press mechanism in a papermaking apparatus. FIG. 4 is a schematic view of a flexing fatigue test used in the present invention. FIG. 5 is a schematic view of tensile strain test used in the present invention. Tensile strain tests were conducted under the conditions to be described next. Each specimen 51 was dimensioned to have a width of 10 mm, a length of 120 mm (including 40 mm grip sections), an inter-grip distance of 40 mm, and a thickness of 1 mm. The specimen 51 was secured to grips 52, and pulled at a rate of 200 mm/min to 100% elongation. After the elongation reached 100%, the applied elongation was instantaneously released at the same rate. At the time that the stress decreased to 0 $kg/cm^2$, the elongation was measured as a permanent strain.

As the reinforcing fiber base material 6, the reinforcing fiber base materials described in documents other than Patent Documents 1 to 6 can be used, as well as woven fabrics described in Patent Documents 1 to 6. The reinforcing fiber base material can be, for example, a grid-patterned material formed of twisted 5,000 dtex multifilament yarns of polyethylene terephthalate (PET) fibers as machine direction (MD) yarns and cross-machine direction (CMD) yarns such that the MD yarns are held by the CMD yarns and the MD yarns and CMD yarns are joined together at intersections thereof with a polyurethane adhesive. The MD yarns and CMD yarns can each be formed by twisting one or more of such multifilament yarns. As the fiber material, aramid fibers or polyamide fibers such as nylon-6,6, nylon-6,10 or nylon-6 fibers may be used instead of the polyethylene terephthalate fibers. Further, fibers of different materials may be used as MD yarns and CMD yarns, respectively, or yarns of different dtex sizes such as 5,000 dtex and 7,000 dtex may be used as MD yarns and CMD yarns, respectively.

The polyurethane that forms an outer circumferential layer 2*a* of each shoe press belt is a polyurethane of a JIS A hardness of 92 to 99 degrees, preferably 94 to 97 degrees, which is obtainable by curing a composition of a urethane prepolymer (A), which is obtainable by reacting an isocyanate compound, the isocyanate compound containing 55 to 100 mol % of a p-phenylene diisocyanate compound, with a long-chain polyol and has terminal isocyanate groups, and a curing agent (B), which contains one or more organic polyamine compound having active hydrogen groups (H) and selected from 4,4'-methylene bis(2,6-diethyl-3-chloroaniline), 4,4'-methylene bis(2-chloroaniline), methylene bis(2-ethyl-6-methylaniline), 4,4'-methylene bis(2-ethylbenzeneamine), methylene bis(2,3-dichloroaniline), 4,4'-methylenedianiline, 3,5-dimethylthiotoluene-2,4-diamine, 3,5-dimethylthiotoluene-2,6-diamine, 3,5-diethyltoluene-2,4-diamine, 3,5-diethyltoluene-2,6-diamine, polytetramethylene oxide di-p-aminobenzoate, poly(tetramethylene/3-methyl tetramethylene ether)glycol bis(4-aminobenzoate), trimethylene bis(4-aminobenzoate) and isobutyl 4-chloro-3,5-diaminobenzoate, in which the urethane prepolymer (A) and the curing agent (B) are mixed together in a ratio such that the value of an equivalent ratio (H/NCO) of the active hydrogen groups (H) in the curing agent to the isocyanate groups (NCO) in the urethane prepolymer satisfies $0.88<H/NCO\leqq1.0$.

As the isocyanate compound for the urethane prepolymer (A), p-phenylene diisocyanate (PPDI) can be used at 55 to 100 mol %, preferably 75 mol % or more in the isocyanate compound. As an isocyanate compound other than PPDI, 2,4-tolylene diisocyanate (2,4-TDI), 2,6-tolylene diisocyanate (2,6-TDI), 4,4'-methylene bis(phenylisocyanate) (MDI) or 1,5-naphthylene diisocyanate (NDI) can be used at 45 mol % or less, preferably 25 mol % or less in combination.

As the long-chain polyol for the urethane prepolymer (A), one or more polyol compounds selected from polyether polyols, polyester polyols, polycaprolactone polyols and polycarbonate polyols can be used.

As the curing agent (B), one or more organic polyamines having active hydrogen groups (H), which are selected from 4,4'-methylene bis(2,6-diethyl-3-chloroaniline), 4,4'-methylene bis(2-chloroaniline), methylene bis(2-ethyl-6-methylaniline), 4,4'-methylene bis(2-ethylbenzeneamine), methylene bis(2,3-dichloroaniline), 4,4'-methylenedianiline, 3,5-dimethylthiotoluene-2,4-diamine, 3,5-dimethylthiotoluene-2,6-diamine, 3,5-diethyltoluene-2,4-diamine, 3,5-diethyltoluene-2,6-diamine, polytetramethylene oxide di-p-aminobenzoate, poly(tetramethylene/3-methyl tetramethylene ether)glycol bis(4-aminobenzoate), trimethylene bis(4-aminobenzoate) and isobutyl 4-chloro-3,5-diaminobenzoate, can be used at 65 to 100 mol %, preferably 80 mol % or more in the curing agent. Further, one or more compounds selected from organic polyols having active hydrogen groups (H), such as 1,4-butanediol and hydroquinone bis(β-hydroxyethyl)ether, and organic polyamine compounds other than those described above may also be used in combination.

As the polyurethane in the shoe press belt, the above-mentioned polyurethane may be used singly as shown in FIG. 1A, or may be used as a laminate with a polyurethane of another composition.

In a papermaking belt that, like the shoe press belt depicted in FIG. 1B, in which, for example, a reinforcing fiber base material and a polyurethane are integrated with each other, the reinforcing fiber base material is embedded in the polyurethane and the polyurethane is forming an outer circumferential layer 2*a* and an inner circumferential layer 2*b*. The polyurethane that forms the outer circumferential layer 2*a* is a polyurethane of a JIS A hardness of 92 to 99 degrees obtainable by curing a composition of a urethane prepolymer (A), which is obtainable by reacting an isocyanate compound, containing 55 to 100 mol % of a p-phenylene diisocyanate compound, with a long-chain polyol, and has terminal isocyanate groups, and a curing agent (B), which contains one or more organic polyamine compound, which has active hydrogen groups (H) and is selected from 4,4'-methylene bis(2,6-diethyl-3-chloroaniline), 4,4'-methylene bis(2-chloroaniline), methylene bis(2-ethyl-6-methylaniline), 4,4'-methylene bis(2-ethylbenzeneamine), methylene bis(2,3-dichloroaniline), 4,4'-methylenedianiline, 3,5-dimethylthiotoluene-2,4-diamine, 3,5-dimethylthiotoluene-2,6-diamine, 3,5-diethyltoluene-2,4-diamine, 3,5-diethyltoluene-2,6-diamine, polytetramethylene oxide di-p-aminobenzoate, poly(tetramethylene/3-methyl tetramethylene ether)glycol bis(4-aminobenzoate), trimethylene bis(4-aminobenzoate) and isobutyl 4-chloro-3,5-diaminobenzoate, in which the urethane prepolymer (A) and the curing agent (B) are mixed together in a ratio such that the value of an equivalent ratio (H/NCO) of the active hydrogen groups (H) in the curing agent to the isocyanate groups (NCO) in the urethane prepolymer satisfies $0.88<H/NCO\leqq1.0$. The polyurethane that forms the inner circumferential layer 2*b* is a polyurethane obtainable by curing a composition of a urethane prepolymer (A), which is obtainable by reacting an isocyanate compound, which is selected from 2,4-tolylene diisocyanate (2,4-TDI), 2,6-tolylene diisocyanate (2,6-TDI) and 4,4'-methylene bis(phenylisocyanate), with polytetramethylene glycol, and has terminal isocyanate groups, and a curing agent (B) selected from 3,5-dimethylthiotoluenediamine, hydroquinone bis(β-hydroxyethyl)ether, 3,5-diethyltoluenediamine and 1,4-butanediol, in which the urethane prepolymer (A) and the curing agent (B) are mixed together in a ratio such that the value of an equivalent ratio (H/NCO) of the active hydrogen groups (H) in the curing agent to the isocyanate groups (NCO) in the urethane prepolymer satisfies $0.93<H/NCO<1.05$. The reinforcing fiber base material is embedded in the inner circumferential layer of the polyurethane.

In a shoe press belt that, like the shoe press belt illustrated in FIG. 1C, a reinforcing fiber base material 6 and a polyurethane layer are integrated with each other, the reinforcing fiber base material 6 is embedded in an intermediate layer 2*c* in the polyurethane layer and an outer circumferential layer 2*a* made of the polyurethane and an inner circumferential layer 2*b* made of the polyurethane are laminated on the opposite sides of the intermediate layer 2*b*. The polyurethane that forms the outer circumferential layer 2*a* and inner circumferential layers 2*b* is a polyurethane of a JIS A hardness of 92 to 99 degrees obtainable by curing a composition of a urethane prepolymer (A), which is obtainable by reacting an isocyanate compound, which contains 55 to 100 mol of a p-phenylene diisocyanate compound, with a long-chain polyol and has terminal isocyanate groups, and a curing agent (B), which contains one or more organic polyamine compound having active hydrogen groups (H) selected from 4,4'-methylene bis(2,6-diethyl-3-chloroaniline), 4,4'-methylene bis(2-chloroaniline), methylene bis(2-ethyl-6-methylaniline), 4,4'-methylene bis(2-ethylbenzeneamine), methylene bis(2,3-dichloroaniline), 4,4'-methylenedianiline, 3,5-dimethylthiotoluene-2,4-diamine, 3,5-dimethylthiotoluene-2,6-diamine, 3,5-diethyltoluene-2,4-diamine, 3,5-diethyltoluene-2,6-diamine, polytetramethylene oxide di-p-aminobenzoate, poly(tetramethylene/3-methyl tetramethylene ether)glycol bis(4-aminobenzoate), trimethylene bis(4-aminobenzoate) and isobutyl 4-chloro-3,5-diaminobenzoate, in which the urethane prepolymer (A) and the curing agent (B) are mixed together in a ratio such that the value of an equivalent ratio (H/NCO) of the active hydrogen groups (H) in the curing agent to the isocyanate groups (NCO) in the urethane prepolymer satisfies $0.88<H/NCO\leqq1.0$. The polyurethane that forms the intermediate layer 2*c* is a polyurethane obtainable by curing a composition of a urethane prepolymer (A), which is obtainable by reacting an isocyanate compound, which is selected from 2,4-tolylene diisocyanate (2,4-TDI), 2,6-tolylene diisocyanate (2,6-TDI) and 4,4'-methylene bis(phenylisocyanate), with polytetramethylene glycol, and has terminal isocyanate groups, and a curing agent (B) having active hydrogen groups (H) selected from 3,5-dimethylthiotoluenediamine, 1,4-butanediol, 3,5-diethyltoluenediamine and hydroquinone bis(β-hydroxyethyl)ether in which the urethane prepolymer (A) and the curing agent (B) are mixed together in a ratio such that the value of an equivalent ratio (H/NCO) of the active hydrogen groups (H) in the curing agent to the isocyanate groups (NCO) in the urethane prepolymer satisfies $0.93<H/NCO<1.05$.

The component of the curing agent (B) may preferably be in the form of a complex with a metal salt. As a dispersion medium for the complex, a high boiling-point ester solvent or the like can be used. Usable examples include dioctyl phthalate (DOP) as a phthalate ester and dioctyl adipate (DOA) as an adipate ester. They can be used either singly or in combination. Further, the metal salt may further preferably be sodium chloride.

In each of these shoe press belts making use of such laminated polyurethane layers, the above-mentioned isocyanate compound, long-chain polyol and curing agent may be used in combination with other isocyanate compound, long-chain polyol and curing agent, respectively, in ranges of 35 mol % or less, preferably 15 mol % or less to extents that the object of the present invention is not impaired.

The shoe press belt can be manufactured, for example, as will be described hereinafter. Onto a mandrel with a parting agent coated on a surface thereof, a mixture of a urethane prepolymer and a curing agent, which serves to form an inner circumferential polyurethane layer, is applied such that the inner circumferential polyurethane layer can be formed to a thickness of 0.8 to 3.5 mm on the surface of the mandrel. The resin layer is precured at 70 to 140° C. for 0.5 to one hour. A reinforcing fiber base material is wrapped thereon. A mixture of a urethane prepolymer and a curing agent, which serves to form an intermediate layer, is next applied to a thickness of 0.5 to 2 mm such that the reinforcing fiber base material is impregnated and is also bonded to the inner circumferential layer. The resin layer is precured at 50 to 120° C. for 0.5 to one hour to form the intermediate layer such that the intermediate layer is reinforced by the reinforcing fiber base material. While rotating the mandrel, a mixture of a urethane prepolymer and a curing agent, which serves to form an outer circumferential polyurethane layer, is subsequently applied such that the outer circumferential polyurethane layer is formed to a thickness of 1.5 to 4 mm on a surface of the reinforcing fiber base material while impregnating the reinforcing fiber base material, and the resin layer is heated and cured at 70 to 140° C. for two to 20 hours. Subsequently, the grooves illustrated in FIG. 2 are cut in the outer circumferential polyurethane layer. The cutting of the grooves in the outer circumferential polyurethane layer can be performed by pressing a heated embossing roll, which is equipped on a surface thereof with ridges of a height equal to the depth of the grooves, against the outer circumferential polyurethane layer under curing in the course of the heated curing of the outer circumferential polyurethane layer. It is to be noted that the mandrel is equipped with a heater.

As another illustrative process for the manufacture of the above-described shoe press belt, a mixture of a urethane prepolymer and a curing agent, which serves to form a polyurethane layer, is applied onto a mandrel with a parting agent coated on a surface thereof such that the inner circumferential polyurethane layer can be formed to a thickness of 0.8 to 3 mm. The resin layer is precured at 70 to 140° C. for 0.5 to two hours. After a reinforcing fiber base material is then wrapped on an outer surface of the precured polyurethane layer, a mixture of a urethane prepolymer and a curing agent, which serves to form an intermediate layer, is applied to a thickness of 0.5 to 2 mm such that the reinforcing fiber base material is impregnated and is also bonded to the inner circumferential layer. The resin layer is supplementary cured at 50 to 120° C. for 0.5 to one hour to form the intermediate layer reinforced with the reinforcing fiber base material. A mixture of a urethane prepolymer and a curing agent, which serves to form an outer circumferential layer, is next applied such that a polyurethane layer is formed to a thickness of 2 to 4 mm, and the resin layer is postcured at 70 to 140° C. for 12 to 20 hours. Grooves are then cut by a cutting bite in the outer circumferential surface of the laminated polyurethane in which the reinforcing fiber base material is embedded, and subsequently, the outer circumferential surface is ground by a sandpaper or polyurethane abrasive cloth.

As a further illustrative process for the manufacture of the above-described shoe press belt having an intermediate layer, a mixture of a urethane prepolymer and a curing agent, which serves to form an inner circumferential layer, is applied onto a mandrel with a parting agent coated on a surface thereof such that the inner circumferential polyurethane layer can be formed to a thickness of 0.8 to 3 mm. The resin layer is precured at 50 to 140° C. for 0.5 to two hours. The intermediate polyurethane layer of 1 to 2 mm thickness, which has been prepared beforehand and includes a reinforcing fiber base material embedded therein, is then wrapped on the inner circumferential layer. The intermediate layer is pressed through nip rolls heated at 50 to 140° C. A mixture of a urethane prepolymer and a curing agent, which serves to form an outer circumferential layer, is further applied to form a polyurethane layer of 2 to 4 mm thickness. The resin layer is postcured at 70 to 140° C. for two to 20 hours. After an outer circumferential surface of the laminated polyurethane with the reinforcing fiber base material embedded therein is ground by a sandpaper or polyurethane abrasive cloth, grooves are cut by a cutting bite in the outer circumferential surface.

In addition to these processes, there is also a process that performs the manufacture by a twin roll instead of using such a mandrel. An endless, woven reinforcing fiber base material is spread between two rolls. Onto an upper surface of the reinforcing fiber base material, a blended mixture of a urethane prepolymer and a curing agent is applied to impregnate the fiber base material with the mixture. After the urethane prepolymer is precured at 50 to 120° C. for 0.5 to two hours, a mixture of a urethane prepolymer and a curing agent, which serves to form an inner circumferential polyurethane layer of the resulting product, is applied to form a polyurethane layer of 0.5 to 3 mm thickness. The resin layer is cured at 70 to 140° C. for two to 12 hours. A surface of the thus-obtained cured layer is ground by a sandpaper or polyurethane abrasive cloth to form a unitary structure in which the inner circumferential layer and the reinforcing fiber base material of the product are bonded together. The half-finished product is reversed inside out, and is then applied to the two rolls such that it is spread between two rolls. Through an upper surface of the thus-spread half-finished product, a blended mixture of a urethane prepolymer and a curing agent is applied to impregnate the reinforcing fiber base material with the mixture. A mixture of a urethane prepolymer and a curing agent is then applied onto the surface of the half-finished product to a thickness of 1.5 to 4 mm. The resin layer is then cured at 70 to 140° C. for two to 20 hours. After completion of the curing, the surface layer was ground to a predetermined thickness, and grooves are cut by a cutting bite to form an outer circumferential layer.

EXAMPLES

To evaluate physical properties of polyurethanes for forming shoe press belts, polyurethane specimens were produced as will be described hereinafter.

Referential Example 1

A composition (H/NCO ratio: 0.95) composed of a urethane prepolymer (NCO %: 5.51%, viscosity at 55° C.: 1,800 cps, preheating temperature: 66° C.), which had been obtained by reacting p-phenylene diisocyanate (PPDI) with polytetramethylene glycol (PTMG), and a curing agent, which is composed of 90 mol % of 4,4'-methylene bis(2,6-diethyl-3-chloroaniline) ("LONZACURE M-CDEA," trade name; product of Lonza Japan Ltd.) and 10 mol % of 3,5-diethyltoluenediamine ("ETHACURE 100," trade name; product of Albemarle Corporation), was injected into a preheated mold, heated to 127° C., and then precured at 127° C. for 0.5 hour. The precured product was then removed from the mold, followed by postcuring at 127° C. for 16 hours to obtain a polyurethane sheet. From the sheet, specimens (thickness: 1.0 mm) were prepared.

Referential Example 2

A composition (H/NCO ratio: 0.95) composed of a urethane prepolymer (NCO %: 5.51%, viscosity at 55° C.: 1,800 cps, preheating temperature: 66° C.), which had been obtained by reacting p-phenylene diisocyanate (PPDI) with polytetramethylene glycol (PTMG), and a curing agent, which is composed of 90 mol % of 4,4'-methylene bis(2-chloroaniline) ("MOCA") and 10 mol % of 3,5-dimethylthiotoluenediamine ("ETHACURE 300"), was injected into a preheated mold, heated to 127° C., and then precured at 127° C. for 0.5 hour. The precured product was then removed from the mold, followed by postcuring at 127° C. for 16 hours to obtain a polyurethane sheet. From the sheet, specimens (thickness: 1.0 mm) were prepared.

Referential Example 3

A composition (H/NCO ratio: 0.95) composed of a urethane prepolymer (NCO %: 5.51%, viscosity at 55° C.: 1,800 cps, preheating temperature: 66° C.), which had been obtained by reacting p-phenylene diisocyanate (PPDI) with polytetramethylene glycol (PTMG), and a curing agent, which is composed of a complex of 4,4'-methylene dianiline with sodium chloride ("CAYTUR 21," trade name; product of E.I. DuPont de Nemours & Company) as dispersed in dioctyl phthalate (DOP), was injected into a preheated mold, heated to 127° C., and then precured at 127° C. for 0.5 hour. The precured product was then removed from the mold, followed by postcuring at 127° C. for 16 hours to obtain a polyurethane sheet. From the sheet, specimens (thickness: 1.0 mm) were prepared.

Referential Example 4

A composition (H/NCO ratio: 0.95) composed of a urethane prepolymer (NCO %: 5.51%, viscosity at 55° C.: 1,800 cps, preheating temperature: 66° C.), which had been obtained by reacting p-phenylene diisocyanate (PPDI) with polytetramethylene glycol (PTMG), and a curing agent, which is composed of 80 mol % of a complex of 4,4'-methylene dianiline with sodium chloride ("CAYTUR 21") as dispersed in dioctyl phthalate (DOP) and 20 mol % of polytetramethylene oxide di-p-aminobenzoate ("ELASMER 250P," trade name; product of Ihara Chemical Industry Co, Ltd.), was injected into a preheated mold, heated to 127° C., and then precured at 127° C. for 0.5 hour. The precured product was then removed from the mold, followed by postcuring at 127° C. for 16 hours to obtain a polyurethane sheet. From the sheet, specimens (thickness: 1.0 mm) were prepared.

Referential Example 5

For Comparison Purpose

A composition (H/NCO equivalent ratio: 0.95) composed of a urethane prepolymer (NCO %: 6.74%, viscosity at 80° C.: 360 cps, preheating temperature: 66° C.), which had been obtained by reacting a mixture (TDI) of 2,4-tolylene diisocyanate and 2,6-tolylene diisocyanate with polytetramethylene glycol (PTMG), and a curing agent, which is composed of 3,5-dimethylthiotoluenediamine ("ETHACURE 300"), was injected into a preheated mold, heated to 100° C., precured at 100° C. for 0.5 hour, and then postcured at 100° C. for 16 hours to obtain a polyurethane sheet. From the sheet, specimens (thickness: 1.0 mm) were prepared.

Referential Example 6

For Comparison Purpose

A composition (H/NCO ratio: 0.95) composed of a urethane prepolymer (NCO %: 5.51%, viscosity at 55° C.: 1,800 cps, preheating temperature: 66° C.), which had been obtained by reacting p-phenylene diisocyanate (PPDI) with polytetramethylene glycol (PTMG), and a curing agent, which is composed of 1,4-butanediol (1,4-BD), was injected into a preheated mold, heated to 127° C., and then precured at 127° C. for 0.5 hour. The precured product was then removed from the mold, followed by postcuring at 127° C. for 16 hours to obtain a polyurethane sheet. From the sheet, specimens (thickness: 1.0 mm) were prepared.

The thus-prepared specimens were evaluated for tensile strain. The evaluation results are presented in Table 1.

A tensile strain testing machine is illustrated in FIG. 5. Each specimen 51 was dimensioned to have a width of 10 mm, a length of 120 mm (including 40 mm grip sections), an inter-grip distance of 40 mm, and a thickness of 1 mm. The specimen 51 was secured to grips 52, and pulled at a rate of 200 mm/min to 100% elongation. After the elongation reached 100%, the applied elongation was instantaneously released at the same rate. At the time that the stress decreased to 0 kg/cm$^2$, the elongation was measured as a permanent strain.

TABLE 1

| | Ref. Ex. 1 Ex. 1 | Ref. Ex. 2 Ex. 2 | Ref. Ex. 3 Ex. 3 | Ref. Ex. 4 Ex. 4 | Ref. Ex. 5 Comp. Ex. 1 | Ref. Ex. 6 Comp. Ex. 2 |
|---|---|---|---|---|---|---|
| Urethane prepolymer | | | | | | |
| Isocyanate | PPDI | PPDI | PPDI | PPDI | TDI | PPDI |
| Polyol | PTMG | PTMG | PTMG | PTMG | PTMG | PTMG |
| NCO (%) | 5.51 | 5.51 | 5.51 | 5.51 | 6.74 | 5.51 |
| Viscosity (cps) | 1800 (at 55° C.) | 1800 (at 55° C.) | 1800 (at 55° C.) | 1800 (at 55° C.) | 360 (at 80° C.) | 1800 (at 55° C.) |
| Preheating temperature (° C.) | 66 | 66 | 66 | 66 | 66 | 66 |
| Curing agent (Compound name) | LONZACURE M-CDEA | MOCA | CAYTUR 21 | CAYTUR 21 | ETHACURE 300 | 1,4-BD |
| Equivalent value | 189 | 134 | 182 | 182 | 107 | 45 |
| Active hydrogen (mol %) | 90 | 90 | 100 | 80 | 100 | 100 |
| Preheating temperature (° C.) | 100 | 116 | 24 | 24 | 24 | 24 |
| Curing agent (Compound name) | ETHACURE 100 | ETHACURE 300 | | ELASMER 250P | | |
| Active hydrogen (mol %) | 10 | 10 | | 20 | | |
| Equivalent value | 89 | 89 | | 244 | | |
| Preheating temperature (° C.) | 24 | 24 | | 50 | | |
| Equivalent value of curing agent | 179 | 129 | 182 | 194 | 107 | 45 |
| Composition (H/NCO ratio) | 0.95 | 0.95 | 0.95 | 0.95 | 0.95 | 0.95 |
| Added amount of curing agent (parts) | 22.3 | 16.1 | 22.7 | 24.2 | 16.3 | 5.6 |
| Precuring conditions (° C./hr) | 127/0.5 | 127/0.5 | 127/0.5 | 127/0.5 | 100/0.5 | 127/0.5 |
| Postcuring conditions (° C./hr) | 127/16 | 127/16 | 127/16 | 127/16 | 100/16 | 127/16 |
| Physical property of polyurethane Tensile strain (%) | 19.1 | 19.8 | 25.1 | 21.3 | 31.3 | 39.6 |

As seen from Table 1, the specimens of Referential Example 1 to Referential Example 4 were about 50 to 80% lower in tensile strain than that of the conventional art product of Referential Example 5 and Referential Example 6 and hence excelled significantly.

A description will next be made of examples in which shoe press belts were produced using the polyurethane compositions as employed in Referential Example 1 through Referential Example 6.

Example 1

Step 1: On a surface of a mandrel of 1,500 mm in diameter rotatable by desired drive means, a parting agent ("KS-61," trade name; product of Shin-Etsu Chemical Co., Ltd.) was applied. While rotating the mandrel, the same urethane prepolymer composition as that employed in Referential Example 5, which was composed of the urethane prepolymer (TDI/PTMG-based prepolymer) and "ETHACURE 300," curing agent, mixed together to have an H/NCO equivalent ratio of 0.95, was applied in a spiral pattern (hereinafter called "by spiral coating") onto the rotating mandrel to a thickness of 1.4 mm by an injection molding nozzle, which was movable in parallel with the axis of rotation of the mandrel, to form a urethane resin layer. With the mandrel still maintained in rotation, the urethane resin layer was left over at room temperature for 40 minutes. By a heater which the mandrel was equipped with, the resin was then heated and precured at 127° C. for 0.5 hour to prepare a shoe-side, inner circumferential polyurethane layer.

Step 2: Provided were grid-patterned materials formed of twisted 5,000 dtex multifilament yarns of polyethylene terephthalate fibers as CMD yarns and 550 dtex multifilament yarns of polyethylene terephthalate fibers as MD yarns such that the MD yarns were held by the CMD yarns and the CMD yarns and MD yarns were joined together at intersections thereof with a urethane-based adhesive (MD yarn density: 1 yarn/cm, CMD yarn density: 4 yarns/cm). The plural sheets of grid-patterned material were disposed as a single layer on an outer circumference of the shoe-side layer with no space left between the plural sheets such that the CMD yarns extended along the direction of the axis of the mandrel. On an outer circumference of the grid-patterned material, 6,700 dtex multifilament yarns of polyethylene terephthalate fibers were then spirally wound at a pitch of 30 yarns/5 cm to form a wound yarn layer. Subsequently, the polyurethane composition as the above-described one was applied as an intermediate layer to a thickness of approx. 1.6 mm such that spaces in the grid-patterned material and wound yarn layer were filled up to unite them into an intermediate polyurethane layer with the grid-patterned material embedded therein.

Step 3: Onto the intermediate layer, the polyurethane composition as that employed in Referential Example 1, which was composed of the urethane prepolymer (PPDI/PTMG-based prepolymer) and the curing agent, which composed of 90 mol % of "LONZACURE M-CDEA" and 10 mol % of "ETHACURE 100," mixed together to have an H/NCO equivalent ratio of 0.95, was applied by spiral coating to a thickness of approx. 2.5 mm. The thus-applied composition was then heated and postcured at 127° C. for 16 hours to form an outer circumferential layer. After the outer circumferential layer was ground at its surface to adjust the total thickness to 5.2 mm, a great number of concave-grooves (groove width:

1.0 mm, depth: 1.0 mm, pitch width: 3.18 mm) were formed in the MD direction of the belt by a rotary blade to obtain a shoe press belt.

Example 2

A shoe press belt was obtained in a similar manner as in Example 1 except that the polyurethane composition as that employed in Referential Example 2 (the polyurethane composition composed of the PPDI/PTMG-based prepolymer and the mixed curing agent composed of 90 mol % of "MOCA" and 10 mol % of "ETHACURE 300") was used in place of the polyurethane composition as the that employed in Referential Example 1.

Example 3

A shoe press belt was obtained in a similar manner as in Example 1 except that the polyurethane composition as that employed in Referential Example 3 (the polyurethane composition composed of the PPDI/PTMG-based prepolymer and "CAYTUR 21") was used in place of the polyurethane composition as that employed in Referential Example 1.

Example 4

A shoe press belt was obtained in a similar manner as in Example 1 except that the polyurethane composition as that employed in Referential Example 4 (the polyurethane composition composed of the PPDI/PTMG-based prepolymer and the mixed curing agent composed of 80 mol % of "CAYTUR 21" and 20 mol % of "ELASMER 250P") was used in place of the polyurethane composition as that employed in Referential Example 1.

Comparative Example 1

A shoe press belt was obtained in a similar manner as in Example 1 except that the polyurethane composition as that employed in Referential Example 5 (the polyurethane composition composed of the TDI/PTMG-based prepolymer and "ETHACURE 300") was used in place of the same polyurethane composition as that employed in Referential Example 1, and the curing conditions were changed to 100° C./0.5 hour for the precuring and to 100° C./16 hours for the postcuring.

Comparative Example 2

A shoe press belt was obtained in a similar manner as in Comparative Example 1 except that the polyurethane composition as that employed in Referential Example 6 (the polyurethane composition composed of the PPDI/PTMG-based prepolymer and 1,4-BD) was used in place of the same polyurethane composition as that employed in Referential Example 5, and the curing conditions were changed to 127° C./0.5 hour for the precuring.

Figure 6:
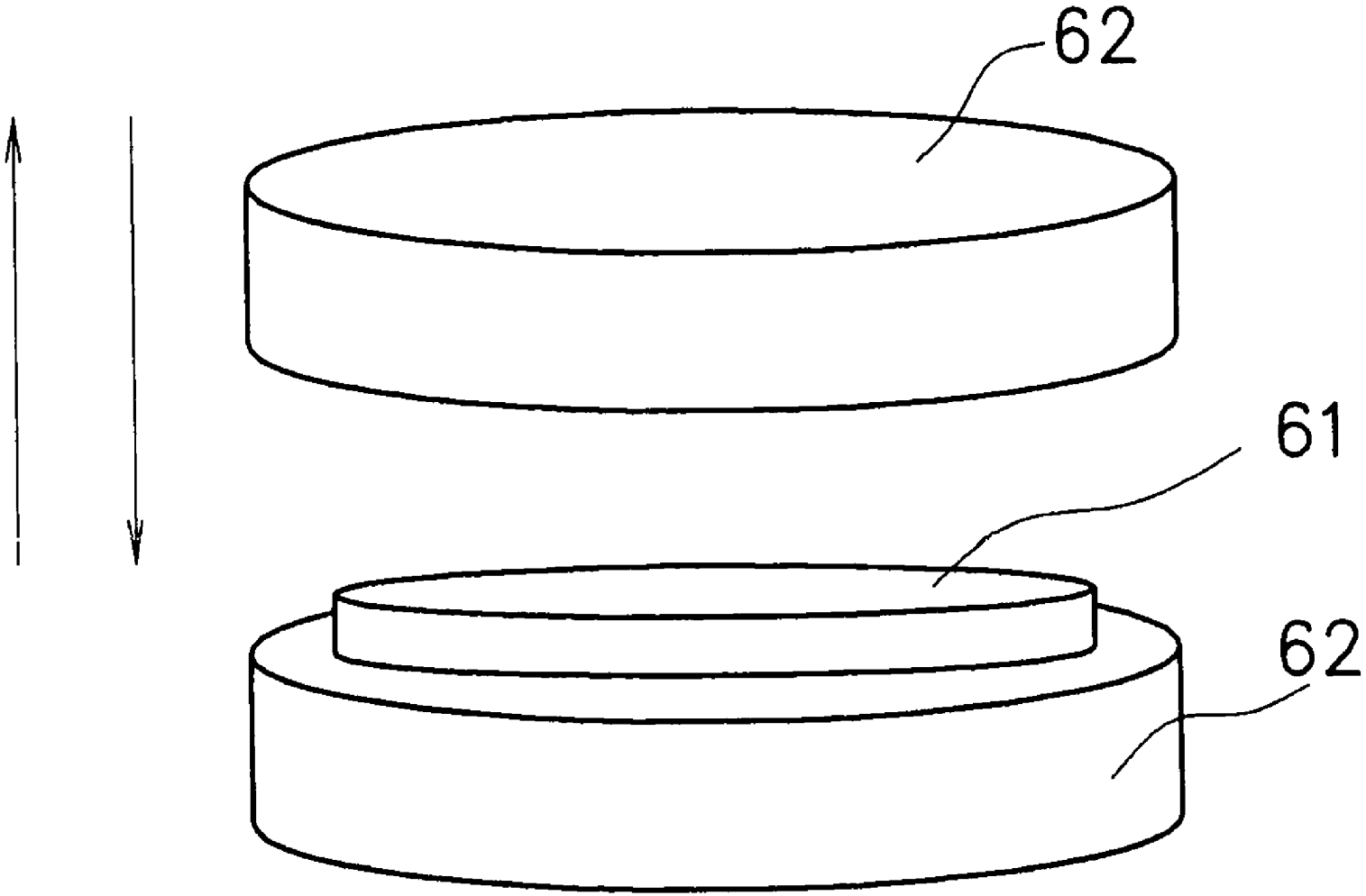
FIG. 6 is a schematic view illustrating a compression strain test.

With respect to the thus-obtained shoe press belts, a compression strain test was conducted. Using an instrument shown in FIG. 6, the compression strain test was conducted under the conditions to be described next. Each specimen 61 was dimensioned to have a diameter of 100 mm and a thickness of 5.2 mm. Before pressing, the total cross-sectional concave-groove area (A) of the specimen 61 was measured in advance. After the specimen 61 was pressed at 80 kg/cm$^2$ for 22 hours between hot disks 62, which were kept at the temperature of 70° C., the pressure was released, and upon an elapsed time of 30 minutes, the total cross-sectional concave-groove area (B) of the specimen 61 was measured. The percentage of the total cross-sectional concave-groove area (B) after the pressing based on the total cross-sectional concave-groove area (A) before the pressing was calculated as the retention (%) of cross-sectional concave-groove area ((B)/(A)×100). The retention (%) of cross-sectional concave-groove area was 97% in Example 1, 96% in Example 2, 90% in Example 3, 95% in Example 4, 80% in Comparative Example 1, and 75% in Comparative Example 2.

TABLE 2

| | Retention (%) of cross-sectional concave-groove area |
|---|---|
| Example 1 | 97 |
| Example 2 | 96 |
| Example 3 | 90 |
| Example 4 | 95 |
| Comp. Ex. 1 | 80 |
| Comp. Ex. 2 | 75 |

It is appreciated from Table 2 that the shoe press belt of Example 1 had a retention (%) of cross-sectional concave-groove area approx. 1.3 times that of the conventional art product of Comparative Example 2 and was hence equipped with significantly-improved water squeezability.

Example 5

A shoe press belt was obtained in a similar manner as in Example 1 except that a polyurethane composition, which was composed of the PPDI/PTMG-based prepolymer and a mixed curing agent composed of 90 mol % of "ETHACURE 300" and 10 mol % of "ETHACURE 100," was used in place of the polyurethane composition as that employed in Referential Example 1.

Example 6

A shoe press belt was obtained in a similar manner as in Example 1 except that a polyurethane composition, which was composed of the PPDI/PTMG-based prepolymer and a mixed curing agent composed of 70 mol % of "CAYTUR 21" and 30 mol % of "ETHACURE 300," was used in place of the polyurethane composition as that employed in Referential Example 1.

Example 7

A shoe press belt was obtained in a similar manner as in Example 1 except that a polyurethane composition, which was composed of the PPDI/PTMG-based prepolymer and a mixed curing agent composed of 85 mol % of "LONZACURE M-CDEA" and 15 mol % of 1,4-BD, was used in place of the polyurethane composition as that employed in Referential Example 1.

Example 8

Step 1: On a surface of a mandrel of 1,500 mm in diameter rotatable by desired drive means, a parting agent ("KS-61") was applied. While rotating the mandrel, the same prepolymer composition as that employed in Referential Example 1, which was composed of the urethane prepolymer (PPDI/PTMG-based prepolymer) and the curing agent, which composed of 90 mol % of "LONZACURE M-CDEA" and 10 mol % of "ETHACURE 100," mixed together to have an H/NCO equivalent ratio of 0.95, was applied by spiral pattern (hereinafter called "by spiral coating") onto the rotating mandrel to a thickness of 1.4 mm by an injection molding nozzle, which was movable in parallel with the axis of rotation of the mandrel, to form a urethane resin layer. With the mandrel still maintained in rotation, the urethane resin layer was left over at room temperature for ten minutes. By a heater which the mandrel was equipped with, the resin was then heated and precured at 127° C. for 0.5 hour to prepare a shoe-side, inner circumferential polyurethane layer.

Step 2: Provided were grid-patterned materials formed of twisted 5,000 dtex multifilament yarns of polyethylene terephthalate fibers as CMD yarns and 550 dtex multifilament yarns of polyethylene terephthalate fibers as MD yarns such that the MD yarns were held by the CMD yarns and the CMD yarns and MD yarns were joined together at intersections thereof with a urethane-based adhesive (MD yarn density: 1 yarn/cm, CMD yarn density: 4 yarns/cm). The plural sheets of grid-patterned material were disposed as a single layer on an outer circumference of the shoe-side layer with no space left between the plural sheets such that the CMD yarns extended along the direction of the axis of the mandrel. On an outer circumference of the grid-patterned material, 6,700 dtex multifilament yarns of polyethylene terephthalate fibers were then spirally wound at a pitch of 30 yarns/5 cm to form a wound yarn layer. Subsequently, the same urethane prepolymer composition as the above-described one was applied as an intermediate layer to a thickness of approx. 1.6 mm such that spaces in the grid-patterned material and wound yarn layer were filled up to unite them into an intermediate polyurethane layer with the grid-patterned material embedded therein.

Step 3: Onto the intermediate layer, the same composition as that employed in Referential Example 1—which was composed of the urethane prepolymer (PPDI/PTMG-based prepolymer) and the curing agent, which composed of 90 mol % of "LONZACURE M-CDEA" and 10 mol % of "ETHACURE 100," mixed together to give the H/NCO equivalent ratio of 0.95, was applied by spiral coating to a thickness of approx. 2.5 mm. The thus-applied composition was then heated and postcured at 127° C. for 16 hours to form an outer circumferential layer. After the outer circumferential layer was ground at its surface to adjust the total thickness to 5.2 mm, a great number of concave-grooves (groove width: 1.0 mm, depth: 1.0 mm, pitch width: 3.18 mm) were formed in the MD direction of the belt by a rotary blade to obtain a shoe press belt.

INDUSTRIAL APPLICABILITY

A shoe press belt according to the present invention is excellent in concave-groove retaining comparing to the conventional products, and expected to show water squeezability greater by approx. 1.2 times or so than those of the conventional products

REFERENCE SIGNS LIST

1 Press roll
2 Shoe press belt
3 transfer felt
4 wet paper
5 shoe
6 reinforcing fiber base material
2*a* outer circumferential layer
2*b* inner circumferential layer
2*c* intermediate layer
21 outer circumferential layer
22 inner circumferential layer
24 concave groove
25 convex area
41 specimen
42*a* lower grip
42*b* upper grip
51 specimen
52 grip
61 specimen
62 hot disk

What is claimed is:

1. A papermaking shoe press belt, comprising a reinforcing fiber base and a polyurethane layer that are integral with each other, the reinforcing fiber base being embedded in the polyurethane layer, wherein:

the polyurethane layer comprises a polyurethane obtained by curing a composition comprising a urethane prepolymer (A) and a curing agent (B) having active hydrogen groups (H);

the urethane prepolymer (A) comprises a terminal isocyanate group, and is obtained by reacting an isocyanate compound comprising 55 to 100 mol % of p-phenylene diisocyanate with polytetramethylene glycol;

the curing agent (B) comprises 65 to 100 mol % of at least one organic polyamine compound having the active hydrogen groups (H) selected from ($B_1$) and ($B_2$):

($B_1$) 4,4'-methylenedianiline or a complex of 4,4'-methylenedianiline and sodium chloride; and ($B_2$) 4,4'-methylene bis(2,6-diethyl-3-chloroaniline).

2. The papermaking shoe press belt according to claim 1, wherein the papermaking shoe press belt has at least one of:

a tensile strain of 25.1% or less; and a retention rate (%) of cross-sectional concave groove area of 90% or more.

* * * * *